United States Patent [19]

Gonzales

[11] Patent Number: 5,048,255

[45] Date of Patent: Sep. 17, 1991

[54] MOLDED THERMOPLASTIC ROOFING TILE

[76] Inventor: Arthur S. Gonzales, 3113 Half Circle Dr., Norco, Calif. 91760

[21] Appl. No.: 478,926

[22] Filed: Feb. 12, 1990

[51] Int. Cl.[5] ..... E04D 1/30; E04D 1/24

[52] U.S. Cl. ..... 52/533; 52/535; 52/536; 52/537; 52/538

[58] Field of Search ..... 52/302, 533, 555, 538, 52/536, 537, 535, 522

[56] References Cited

U.S. PATENT DOCUMENTS

| | | | |
|---|---|---|---|
| 511,506 | 12/1893 | Cheeseman | 52/536 |
| 1,063,674 | 6/1913 | Freund | 52/533 |
| 1,416,583 | 5/1922 | Seiler et al. | 52/538 |
| 2,119,921 | 6/1938 | Levy | 52/522 X |
| 3,579,940 | 5/1971 | Greenleaf | 52/536 X |
| 3,783,570 | 1/1974 | Storch | 52/536 X |
| 4,343,126 | 8/1982 | Hoofe, III | 52/555 X |
| 4,680,911 | 7/1987 | Davis et al. | 52/536 X |
| 4,783,944 | 11/1988 | Mendez | 52/536 |
| 4,901,490 | 2/1990 | Zinniel et al. | 52/126.6 X |
| 4,949,522 | 8/1990 | Harada | 52/533 |

FOREIGN PATENT DOCUMENTS

| | | | |
|---|---|---|---|
| 153672 | 1/1938 | Austria | 52/536 |
| 248657 | 8/1966 | Fed. Rep. of Germany | 52/533 |
| 3343568 | 6/1985 | Fed. Rep. of Germany | 52/536 |
| 516405 | 4/1921 | France | 52/520 |
| 1008112 | 5/1952 | France | 52/536 |
| 1097530 | 7/1955 | France | 52/536 |
| 2170834 | 8/1986 | United Kingdom | 52/533 |

*Primary Examiner*—Richard E. Chilcot, Jr.
*Assistant Examiner*—Deborah McGann Ripley
*Attorney, Agent, or Firm*—Gordon K. Anderson

[57] ABSTRACT

A roofing tile which has a corrugated thin top wall (11) with an upper shelf (17). The tile is slopingly angled and contains an overhang on the lower edge such that overlapping is accomplished when layed contiguously on a roof (13). One lateral edge includes an upwardly facing shelf or pocket (71) having a pair of beads (77) defining a rain trough (79). An overhang flange (41) on the opposite edge allows the tiles to nest forming a water resistant joint. A support grid (15) is formed by a number of intersecting longitudinally diagonally and transversely extending wall segments integrally formed with the top wall provide a sturdy support. The shelf further contains a number of sockets (21) and the overhang (19) contains a matingly shaped flange member (23) which join together when layed one on the other creating an indexing interface aligning the tiles together and preventing slipping apart. A pair of nails are driven into the roof through holes (69) to further attach the tiles.

17 Claims, 1 Drawing Sheet

MOLDED THERMOPLASTIC ROOFING TILE

TECHNICAL FIELD

This invention relates to roofing tiles in general, and more particularly to lightweight molded thermoplastic roofing tiles that interlockingly overlap laterally and longitudinally.

BACKGROUND ART

Roofing material varies widely and has been the subject of much innovation, as shown by a review of the prior art. Conventional roofing material, such as tile, concrete, or composition tar paper is heavy, requires a great deal of manual labor to install, and requires significant maintenance over time. Attempts have been made to address these difficulties, but prior to this invention no satisfactory solution existed.

Examples of prior art efforts have been found but have been limited to molded plastic tiles which may be interlocked at their adjacent edges and which are formed with nailing tabs or the like for securement to the underlying roof structure.

A search of the prior art did not disclose any patents that read directly on the claims of the instant invention, however, the following U.S. patents were considered related:

| U.S. Pat. No. | Inventor | Filing Date |
|---|---|---|
| 4,680,911 | Davis et al | Jul. 21, 1987 |
| 4,522,002 | Davis et al | Jun. 11, 1985 |
| 4,343,126 | Hoofe | Aug. 10, 1982 |
| 4,251,967 | Hoofe | Feb. 24, 1981 |
| 3,862,532 | Markos | Jan. 28, 1975 |
| 3,783,570 | Storch | Jan. 8, 1974 |
| 3,579,940 | Greenleaf | May 25, 1971 |
| 2,119,921 | Levy | Jun. 7, 1938 |

An example of a prior art roof tile is shown in the U.S. Patent issued to Markos. This tile construction is in the form of a planar top wall formed on its underside with longitudinal ribs and along its opposite extremities with interlocking channels. Such tiles, while being satisfactory for their intended use, fail to incorporate socket and pin construction at the upper and lower extremities for interlocking together and further fail to incorporate underlying support grid of wall segments which possess sufficient structural integrity to enable a tile constructed of relatively economical polyethylene to possess the necessary structural soundness for practical applications.

Storch teaches a roofing system with sealing and fastening means on the longitudinal and lateral edges of adjacent tiles. Further, special sections are included for hip peaks, valleys, and ridges with filler pieces to adjust for length. The material of construction is molded resinous plastic material.

Greenleaf employs molded plastic including a synthetic polymer composition material with nailing bosses positioned adjacent to an upturned flange on the top end of a planar top panel. An upstanding transverse flange is included on the resting flange on the top edge of the tile acting as a dam. Notches are also included in integral ribs to receive the upturning flange. In one embodiment the upstanding flange lockingly engages the downwardly directed ribs to prevent direct upward lifting of the upper tile. Further, Greenleafs tiles are flat, not corrugated, as in the present invention.

Levy uses basic principles of roof tiles on constructional toys employing elements, such as bricks adapted to be connected one with the other by means of pegs. The integral pegs are forced into apertures or sockets and because of the resiliency of the material and flat portions, along with an enlarged head, the elements snap together preventing inadvertent withdrawal of the peg.

The remaining cited prior art, while satisfactory for their intended purpose, suffer the shortcoming that they do not provide for secure fastening of one to the other for interlocking thereof to prevent the tile from being blown from the roof or becoming disattached therefrom in such a manner as to lend to water seepage or direct leakage into the underlying roof structure.

DISCLOSURE OF THE INVENTION

The lightweight roof tile of the present invention is so constructed and configured as to interlock with adjoining adjacent tiles in a waterproof manner and have a contoured exterior surface which is, nonetheless, uniformly supported by a planar roof surface.

The tiles of the present invention are intended to be assembled together on a pitched roof in a progressive manner from a bottom course along the eaves of the roof progressing upwardly toward the most elevated roof portion. The tiles are constructed such that the top walls thereof will angle downwardly and outwardly from the roof surface, each such tile being formed at its upper extremity with a marginal upwardly facing support surface for receipt thereover of an overhang formed at the lower marginal extremity of the tile immediately adjacent the upper course. Formed in the support surface are a pair of laterally spaced apart sockets which receive complimentary shaped and located pins incorporated in the overhang of the mating tile. The top wall of the tile is supported on a waffle-like matrix of vertical wall segments which cooperate together to support the top wall from such roof surface. One lateral side of the tile is formed with an upwardly opening trough and the opposite lateral side thereof is formed with a complimentary shaped elevated lip formed with downwardly depending flanges which mate with the trough of the laterally adjacent tile to thus afford a sealing effect.

It is an object of the invention to provide an interlocking plastic thin walled roof tile which may be contoured to create an artistic appearance simulating, for example, Spanish tile and, yet, retain the strength of direct support of the corrugated top of the tile from the planar roof surface below.

Another object of the invention is to create a lightweight roof tile.

Still another object of the invention is to create an interlocking roof tile which may be interlocked with other similarly configured roof tiles to create a multitile watertight roof.

Yet another object of the invention is to create a roof tile which may be interlocked with tiles immediately above and below it on the roof by an interfitting pin and socket arrangement.

A further object of the invention is to provide a one-piece roof tile incorporating both the top contoured tile and the support grid.

A still further object of the invention is to create an interlocking roof tile which is convenient and economical to install.

Yet another object of the invention is to create a roof tile which provides an insulating space between the top surface of the roof tile and the underlying roof surface.

A final object of this invention is to provide a roof tile which may simulate Spanish tile by integral corrugations but be strong and lightweight.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
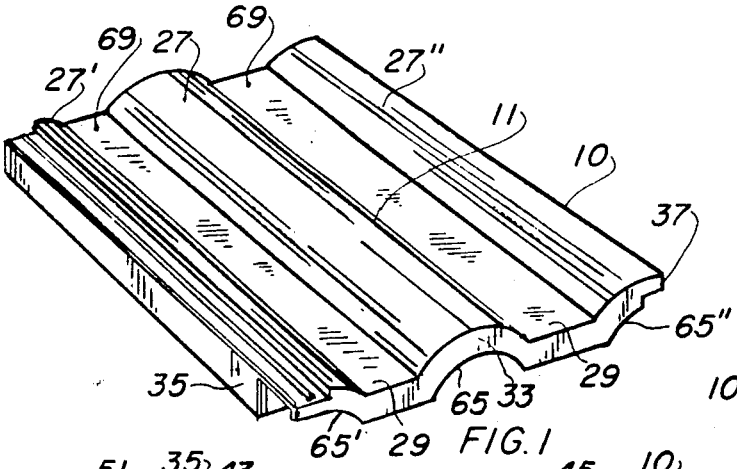
FIG. 1 is a perspective view of a roof tile embodying the present invention.
Figure 2:
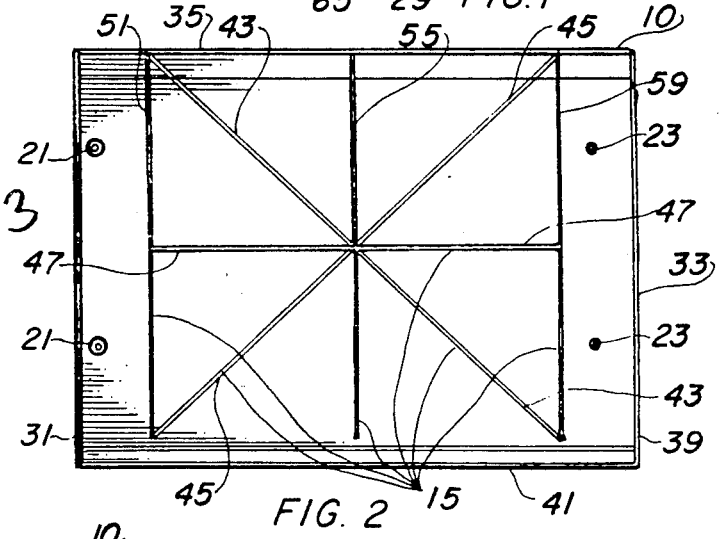
FIG. 2 is a bottom plan view, in enlarged scale, of the roof tile shown in FIG. 1.
Figure 4:
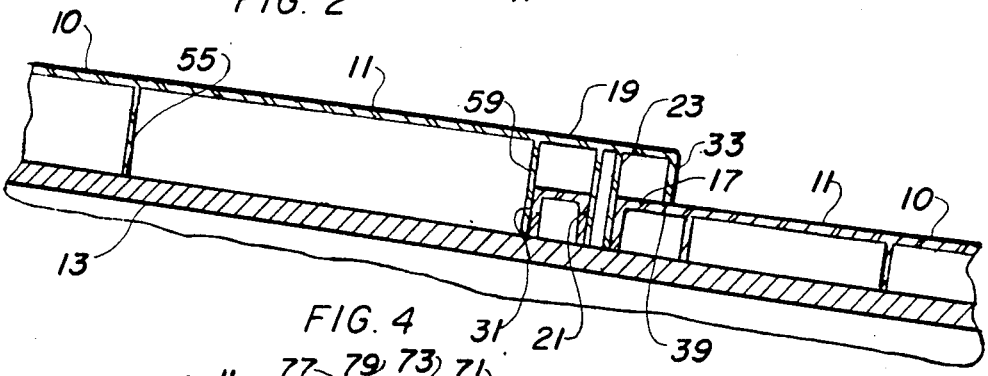
FIG. 4 is an enlarged vertical sectional view taken along line 4—4 of FIG. 3.

The best mode for carrying out the invention is presented in terms of a preferred embodiment. Referring to FIGS. 1 and 2, the roof tiles of the present invention includes, generally, an elongated thin top wall 11, as shown in FIG. 4, which angles downwardly along and away from the surface of a pitched roof 13 and is supported on its underside by a grid 15 of waffle-like wall sections comprising elements 43, 45, 47, 51, 55 and 59 described in greater detail hereinafter. The tile is formed at its upper extremity with an upper marginal support shelf 17, shown in FIG. 4, such that an overhang 19 of an immediately adjacent upper tile will fit thereover. The support shelf 17 is formed with a pair of laterally spaced apart upwardly opening sockets 21 for complimental receipt of a plurality of laterally spaced apart flange members 23 formed on the underside of the mating overhang 19.

The tile itself may be constructed of readily available high density polyethylene and may be conveniently molded by injection molding to thus afford rapid and economical production thereof. The thicknesses of the various walls may be on the order of 1/16 of an inch (0.16 cm), it being appreciated that the particular waffle-like support grid 15 affords a relatively light-weight construction while providing the necessary support for the relatively thin top wall 11.

The top wall 11 is formed with corrugations in the form of elongated, laterally spaced apart, semi-cylindrical domed ridges 27, which form therebetween effective rain gutters 29. Such top wall is formed around its peripheral edges with downturned peripheral walls to form respective upper peripheral walls 31, as shown in FIGS. 2 and 4, lower peripheral walls 33, and oppositely disposed lateral peripheral walls 35 and 37, shown in FIGS. 1 and 2. The upper peripheral wall 31 forms the upper marginal edge of the support shelf 17 and the lower peripheral wall 33 forms the lower edge of the overhang 19. Such lower peripheral wall 33 terminates at a lower edge 39 which abuts the top surface of the adjoining tile 10.

With continued reference to FIG. 4, the support grid 15 is formed by a plurality of intersecting longitudinally, diagonally, and transversely extending walls 47, 43, and 45, also 51, 55 and 59, respectively. It will be appreciated that the transverse wall segments 51, 55, and 59 progressively increase in height as one progresses downwardly along the length of a tile to thereby provide the desired downwardly and outwardly projecting angle of the top wall 11 relative to the top surface of the roof 13. Typically, this angle is on the order of 10 degrees. The longitudinal diagonal and transverse supports 43, 45 and 47 likewise, fan outwardly about 10 degrees as one moves downwardly along the length of the tile, thus causing the bottom edges thereof to cooperate with the bottom edges of the lateral walls forming a generally planar bottom surface such that the resultant grid work will afford a lightweight sturdy support for the top wall 11 preventing undue flexing under load creating a sturdy and rigid structure.

The top wall 11 slopes from a height of 1.0 inch (2.5 cm) above the roof 13 at the upper end to a height of about 1.5 inch (3.8 cm) at the lower end, over an overall length of about 16 inches (40.6 cm). When taken in view of the approximately 1.0 inch (2.5 cm) to 1.5 inch (3.8 cm) vertical heights for the respective support and walls 43 through 47, 51 through 59, plus forming the supporting grid, in combination with the peripheral walls 33, 35 and 31, the tile structure then possesses a high degree of structural integrity.

As is clearly shown in FIG. 4, the lowermost transverse wall segment 59 is spaced upwardly from the fastening flange members 23 a distance sufficient to cause that wall to act as a spacer whereby abutment thereof against the upper peripheral wall 31 of the adjacent lower tile will cause the flange members 23 to be located in longitudinal alignment with the mating sockets 21 of the adjacent lower tile. Sliding the upper tile relative to the next lower tile allows the flange members 23 to register with the mating sockets 21.

The sockets 21 are in the form of open ended barrels formed in the top wall for receipt of the hollow flange members.

Figure 3:
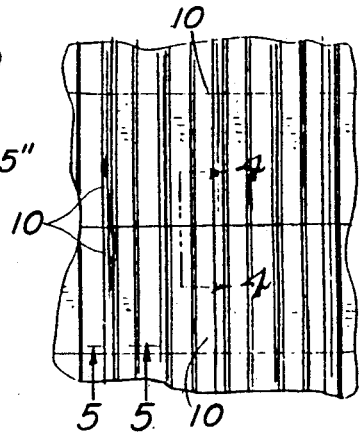
FIG. 3 is a reduced top plan view showing the roof tiles of FIG. 1 installed on a roof.

Referring to FIG. 1 each tile 10 contains one or more semi-cylindrical domed ridges 27 and each outward edge a similar ridge 27' and 27'', except only half of the semi-cylindrical shape. The lower peripheral wall 33 contains a centrally located radial hump 65 and each outward edge a similar hump 65' and 65'', except only half the radial shape. In use the humps 65, 65' and 65'' fit over the adjoining tiles ridge 27, 27' and 27'', as illustrated in FIGS. 3 and 4 and the sides mate giving the appearance of a continuous ridge.

Figure 5:
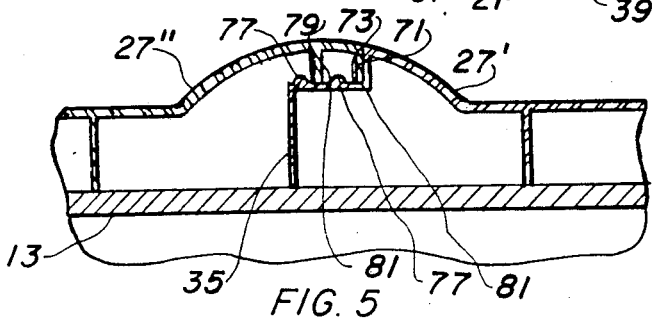
FIG. 5 is an enlarged vertical sectional view taken along line 5—5 of FIG. 3.

The top wall of the preferred tile embodiment, illustrated in FIG. 5, is formed along one lateral side of the semi-cylindrically shaped ridge 27' with a rectangular cross-section recess defining a shelf or pocket 71. This pocket is formed with a bottom wall 73 and then turns downwardly at its side to form the lateral peripheral wall 35. The bottom wall of the elongated pocket 71 is formed with a pair of laterally spaced apart elongated beads 77 which define a rain trough 79 therebetween.

Formed on the opposite lateral extremity of the tile is an overhang flange 41. The flange 41 projects laterally outward from the longitudinal support grid 15 shown in FIG. 5, to form the laterally distal portion of the domed ridge 27'' and is then formed on its underside with a pair of parallel laterally spaced apart downwardly depending ribs 81 which, when the tiles are assembled together, nest on the opposite side of the beads 77 in the pocket 71 of an adjacent tile thus cooperating to form a water resistant joint.

Formed in the top wall at the upper extremity is a plurality of nail holes 69 for convenient receipt of roofing nails utilized to anchor the tile in place on the roof 13.

In operation the plastic tile of the present invention may be conveniently molded of relatively inexpensive and sturdy plastic, thus providing a sturdy tile which is relatively lightweight and convenient to store and ship to the job site. The lightweight characteristic provides tiles which are easy to carry thus enabling workmen to transport relatively large quantity thereof for distribution over the surface of the roof for installation by a roofer.

Installation may be conveniently achieved by laying a first course of tiles along the eaves of the roof. The tiles are conveniently layed by starting at the left hand side of the lower corner of the roof and securing a first tile in position by driving a nail through the nail holes 69. The immediately adjacent lateral tile may then be moved into position by locating the overlap flange 37 over the pocket 71 of the previously installed tile abutting the grid 15 against the peripheral wall 35, shown in FIG. 5, of the previously installed tile and lowering the overhang flange 37 into position within the pocket 71. This then positions the depending ribs 81 on the opposite sides of the bead 77, as shown in FIG. 5, cooperating with the remaining beads 77 and configuration of the pocket forming a water resistent joint. This procedure may then be continued throughout the entire length of the lower course of tile.

Installation of the next higher course of tile may then be commenced and such tile installed substantially as described hereinabove, except that indexing of the higher course relative to the previously installed course of tiles will be facilitated by the laterally extending transverse walls 59, shown in FIG. 4), which abutted against the upper peripheral walls 31 of the prior installed course thereby aligning the respective flange members 23 longitudinally relative to the receiving sockets 21. As the tiles of the upper course are shifted into position, the hump 65, shown in FIG. 1, in the lower peripheral wall 33 will nest over the respective ridges 27' and 27'' of the lower course to further facilitate aligning the flange members 23 laterally relative to the sockets 21. When the courses of tile have been then fully installed to reach the apex of the roof, the trim material may then be installed and the resultant tiled roof will afford a rugged and reliable roof covering. Moisture and rain falling on the roof will be directed downwardly along the rain gutters formed between the ridges 27, 27' and 27''. Any seepage of moisture in the joint formed by the overlap flange 41 and pocket 73 will be resisted by the relatively close fit of the flange in the pocket and by the barrier afforded by the respective downwardly depending ribs 81 and the raised beads 77, all of which cooperate together to form downwardly directed troughs directing such rain downwardly in the resultant joint and resisting seepage through the roof. Likewise, the water impervious characteristic of the lower overhang 19 of each tile positioned over the uppermost shelf of the immediately lower course of tile forms a watertight transition from course to course.

It will also be appreciated by those skilled in the art that the support grid 15 serves to form a series of triangular compartments into which stagnant air is trapped. This air serves as an ideal thermal insulator preventing escape of heat through the roof 13 or transmission of heat from the environment through the roof as the case may be.

From the foregoing it will be apparent that the tile of the present invention is relatively economical to manufacture, lightweight, and convenient to install, while affording a durable and reliable roof covering.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

What is claimed is:

1. A plurality of interlocking thermoplastic roof tiles for covering a pitched planar roof surface, each tile comprising:

(a) an elongated thin top wall formed with a plurality of corrugations defining domed ridges the wall having a lateral upper marginal extremity, a lateral lower marginal extremity, a first longitudinal edge and a second longitudinal edge, said upper marginal extremity defining a shelf configured to, when mounted on such roof surface, angle downwardly therealong and away therefrom to form a predetermined angle relative to said roof surface;

(b) such tile having at said lower marginal extremity a overhang spaced from such roof surface so that each such plurality of tiles will overlap the upwardly facing top wall on the first longitudinal edge, having an elongated upwardly facing pocket defining a trough and on the second longitudinal edge an overhang flange such that laterally adjacent tiles, being complimently configured, permit the flanges and troughs of laterally adjacent tiles to overlie one another, said tile further including;

(c) a support grid under said top wall and formed with a plurality of vertically extending longitudinal, diagonal, and transverse wall segments terminating at extended edges in a common plane with the roof for supporting said top wall from said roof surface and disposed at said predetermined angle relative thereof; and, (d) said top wall shelf having a plurality of upwardly opening socket means and in said overhang having a plurality of flange means such that the flange means of such plurality of tile may be received complimently in the socket means of longitudinally adjacent tiles when installed on a roof.

2. A plurality of interlocking thermoplastic roof tiles according to claim 1 wherein:

said top wall is formed with an elongated drain bead means disposed on said trough for directing water longitudinally downwardly along said trough.

3. A plurality of interlocking thermoplastic roof tiles according to claim 2 wherein:

drain bead means includes a pair of parallel beads.

4. A plurality of interlocking thermoplastic roof tiles according to claim 2 wherein:

said overhang flange is formed with a longitudinal downwardly extending rib means arranged to, when laterally adjacent tiles are mated together, be offset from the bead means of the adjacent tile and terminating in a lower edge spaced from said roof common plane a distance sufficient to cause it to abut the confronting surface of the underlying trough.

5. A plurality of interlocking thermoplastic roof tiles according to claim 4 wherein:

said rib means includes a pair of parallel downwardly extending ribs.

6. A plurality of interlocking thermoplastic roof tiles according to claim 1 wherein:

said top wall is formed with laterally spaced apart domed ridges extending from end to end to form therebetween longitudinal gutters, said overhang being formed on its underside with a bottom surface contoured to, when such tiles are installed on such roof surface, be complimently received over the upper marginal extremities of the ridges and gutters projecting onto the support surface of longitudinally adjacent tiles.

7. A plurality of interlocking thermoplastic roof tiles according the claim 1 wherein:

said thin top wall and transverse wall segments are substantially 1/16 in (0.16 cm) thick and said top walls angle from a height substantially 1.00 inch (2.5 cm) above said roof common plane at said upper marginal extremity to a height of substantially 1.50 in. (3.8 cm) above said roof common plane at said lower marginal extremity.

8. A plurality of interlocking thermoplastic roof tiles according to claim 1 wherein:

said top wall is formed about its periphery with downturned peripheral walls to define respective upper, lower and lateral walls, the lower peripheral wall terminating in a bottom edge configured to, when such tiles are installed on such roof surface, abut against an upper surface of a shelf on the next adjacent lower tile.

9. A plurality of interlocking thermoplastic roof tiles according to claim 8 wherein:

said support grid is formed at an upper extremity of said overhang with a vertical abutment wall for when such tiles are installed on such roof surface with said flange means received in the corresponding socket means abutting the upper peripheral wall of the adjacent lower tile.

10. A plurality of interlocking thermoplastic roof tiles according to claim 9 wherein:

said socket means is in the form of a pair of laterally spaced apart barrels formed in said top wall and said flange means is in the form of a pair of laterally spaced apart flange members formed on the underside of said overhang.

11. A plurality of interlocking thermoplastic roof tiles according to claim 2 wherein:

said top wall is formed with laterally spaced apart domed ridges extending from end to end to form therebetween longitudinal gutters, said overhang being formed on its underside with a bottom surface contoured to, when such tiles are installed on such roof surface, be complimently received over the upper marginal extremities of the ridges and gutters projecting onto the support surfaces of longitudinally adjacent tiles.

12. A plurality of interlocking thermoplastic roof tiles according the claim 2 wherein:

said thin top wall and transverse wall segments are substantially 1/16 in. (0.16 cm) thick and said top walls angle from a height substantially 1.0 in (2.5 cm) about said roof common plane at said upper marginal extremity to a height of substantially 1.5 in. (3.8 cm) above said roof common plane at said lower marginal extremity.

13. A plurality of interlocking thermoplastic roof tiles according to claim 2 wherein:

said top wall is formed about its periphery with downturned peripheral walls to define respective upper, lower and lateral walls, the lower peripheral wall terminating in a bottom edge configured to, when such tiles are installed on such roof surface, abut against an upper surface of the shelf on the next adjacent lower tile.

14. A plurality of interlocking thermoplastic roof tiles according to claim 6 wherein:

said thin top wall transverse wall segments are substantially 1/16 in. (0.16 cm) thick and said top walls angle from a height substantially 1.0 in. (2.5 cm) above said roof common plane at said upper marginal extremity to a height of substantially 1.5 in. (3.8 cm) above said roof common plane at said lower marginal extremity.

15. A plurality of interlocking thermoplastic roof tiles according to claim 6 wherein:

said top wall is formed about its periphery with downturned peripheral walls to define respective upper, lower and lateral walls, the lower peripheral wall terminating in a bottom edge configured to, when such tiles are installed on such roof surface, abut against an upper surface of the shelf on the next adjacent lower tile.

16. A plurality of interlocking thermoplastic roof tiles according to claim 7 wherein:

said top wall is formed about its periphery with downturned peripheral walls to define respective upper, lower and lateral walls, the lower peripheral wall terminating in a bottom edge configured to, when such tiles are installed on such roof surface, abut against an upper surface of the shelf on the next adjacent lower tile.

17. A plurality of interlocking thermoplastic roof tiles according to claim 1 wherein:

said top wall having a plurality of nail holes to secure an tile to a roof.

* * * * *